US005510585A

United States Patent [19]

Duve et al.

[11] Patent Number: 5,510,585

[45] Date of Patent: Apr. 23, 1996

[54] ELECTROMECHANICAL PROGRAMMER/TIMER

[75] Inventors: John P. Duve, Brookfield; Michael F. Misik, Norridge; George A. Soberski, Des Plaines; Lawrence T. Olges, Geneva, all of Ill.

[73] Assignee: Eaton Corporation, Cleveland, Ohio

[21] Appl. No.: 130,077

[22] Filed: Sep. 30, 1993

[51] Int. Cl.[6] ..... H01H 43/00

[52] U.S. Cl. ..... 200/35 R; 200/38 R; 200/38 A

[58] Field of Search ..... 200/33 R–41; 307/141; 74/1.5

[56] References Cited

U.S. PATENT DOCUMENTS

| | | | |
|---|---|---|---|
| Re. 29,086 | 12/1976 | Murphy et al. | 307/141 |
| 3,713,345 | 1/1973 | Sands | 74/1.5 |
| 3,760,129 | 9/1973 | Jullien-Davin | 200/38 R |
| 3,867,642 | 2/1975 | Ajrlahi | 307/141 |
| 4,616,209 | 10/1986 | Mahon | 200/35 R X |
| 4,683,825 | 8/1987 | Moskowitz | 105/148 |
| 4,948,928 | 8/1990 | Willigman | 200/38 R |
| 5,290,978 | 3/1994 | Georgacakis et al. | 200/38 R |

*Primary Examiner*—J. R. Scott
*Attorney, Agent, or Firm*—Roger A. Johnston

[57] ABSTRACT

A programmer/timer for appliances having cam actuated switches with a cam drum advanced by a motor driven four-stage speed-reducing gear train with a missing teeth type intermittent device. The third step gear is readily interchangeable for changing the rate of cam advance. An auxiliary housing with auxiliary cam drum and switches may be added without altering the basic configuration of switches and advance mechanism.

12 Claims, 6 Drawing Sheets

ELECTROMECHANICAL PROGRAMMER/TIMER

BACKGROUND OF THE INVENTION

The present invention relates to electromechanical programmer/timers for controlling the service cycle or program of an appliance such as household washing machines, clothes dryers, and the like. Typically, programmer/timers of this sort utilize a small subfractional AC motor to drive an advance mechanism for advancing a rotary cam which sequentially operates individual program switches for controlling various functions of the appliance. Programmer/timers of this type of construction require different cam arrangements for effecting different sequencing and timing of the program switches.

Heretofore, it has been commonplace to provide a rotary drum having peripheral cam tracks for operating the individual program switches of the timer of the programmer/timer. Where it is desired to change the sequence and timing of the program switches, it has been necessary to fabricate a different set of cam tracks for changing the operation of the program switches. Furthermore, where it has been desired to change the length of the program, it has been required to redesign the advance mechanism to alter the rate of advance to accommodate such changes. Thus, it has been desired to provide a way or means of changing the rate of advance or program in an electromechanical programmer/timer without requiring a change in the program cam which is typically one of the more costly component of the device.

SUMMARY OF THE INVENTION

The present invention employs a subfractional horsepower AC timing motor driving a four-stage speed reducing gear train with the first three stages employing missing tooth-type intermittent drive pinions and gears. The pinions and their associated driven gears are constructed such that during periods of dwell rotation of the driven gear with respect to the pinion is locked by interaction of surfaces provided on the pinion and driven gear. The four-stage reduction permits the third stage pinion and driven gear to be removed and exchanged with a gear having a different number of missing teeth on the pinion without changing the corresponding meshing gears to thereby provide a different rate of advance. The speed reducer final stage drives a rotating cam shaft which has axially received thereon a hub wheel frictionally clutched to drive a cam drum. The cam drum has removable annular cam tracks attached thereto for sequentially, upon rotation, actuating and de-actuating a plurality of appliance program function switches.

The programmer/timer of the present invention may have an optional auxiliary housing portion added over the cam shaft to contain auxiliary program function switches. An auxiliary cam drum is then received over the camshaft with auxiliary cam tracks for driving the auxiliary switches. The construction thus enables the programmer/timer to be manufactured in a base form with an initial cam drum and tracks; and, if desired, an auxiliary cam drum and switches may be added without changing the arrangement of the basic programmer/timer or motor drive advance mechanism.

DETAILED DESCRIPTION

Figure 1:
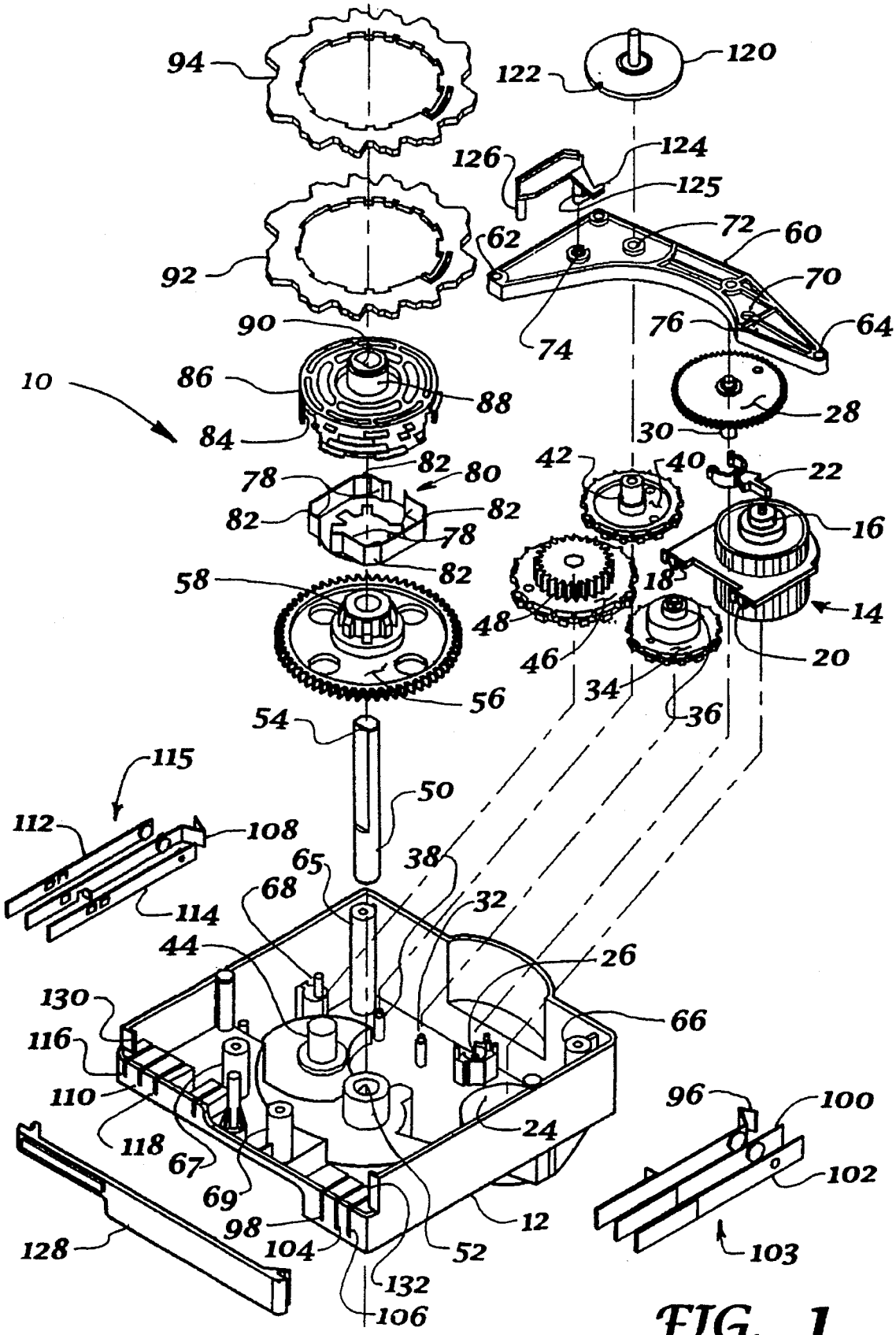
FIG. 1 is an exploded axonometric view of the basic programmer/timer.

Referring to FIG. 1, the programmer/timer is indicated generally at 10, and has a main housing shell 12 which has mounted therein a synchronous timing motor subassembly indicated generally at 14, which has a motor drive pinion 16 provided on the motor shaft, and electrical connector terminals 18,20 extending therefrom. An anti-reverse pall or fork 22 is provided to prevent reverse rotation of the synchronous timing motor, a technique well known in the art. It will be understood that motor subassembly 14 is mounted in a well 24 provided in the bottom of the housing shell 12.

Housing 12 has a first spindle or stanchion 26 provided thereon, upon which is journalled for free rotation thereon a first stage gear 28 which is meshed with motor pinion 16, and which has a smaller diameter output pinion 30 provided on the underside thereof. Pinion 30 has a single drive tooth thereon. A second upright spindle or stanchion 32 is provided in the interior of the housing 12, and extends upwardly from the bottom or lower wall thereof, and has received thereover in freely rotatable registration thereon a second stage gear 34, which has the desired amount of missing teeth thereof to provide an intermittent drive in meshed engagement with pinion 30. Gear 34 has a reduced diameter output pinion 36 formed thereon, which has a single tooth thereon, similar to output stage pinion 30.

A third spindle or stanchion 38 is formed upright in the bottom of the housing 12, and has received thereover in freely rotating registration thereon a third stage gear 40, which has a selected number of missing teeth, and which is positioned for intermittent engagement with the single tooth on pinion 36 of the second stage gear 34. Gear 40 has a reduced diameter output pinion 42 formed integrally thereon which also has a single tooth thereon.

A fourth spindle or stanchion 44 is provided in the housing, and extends vertically from the bottom wall thereof. A fourth stage gear 46 is received thereover and journalled thereon for free rotation thereabout. Fourth stage gear 46 has a desired number of missing teeth, and is meshed with the output pinion 42 of third stage gear 40, to provide intermittent rotation therebetween. Output gear 46 has a fully-toothed reduced diameter drive pinion 48 formed thereon. In the presently preferred practice of the invention, the case 12 and gears 28,34,40,46, and their integrally-formed pinions are molded of suitable thermoplastic material.

A main shaft 50 is provided, and is received in a bore 52 provided in the lower wall of the housing 12, and is journalled for rotation therein. A final stage or output gear 56 is provided, and has a hub 58 received over shaft 50 and freely rotatable thereon, with the gear 56 engaging the drive pinion 48.

A plate 60 has apertures 62,64 provided in opposite ends thereof, each of which has a suitable fastener (not shown) received therethrough for fastening the plate to the housing 12, with aperture 64 aligned with a boss 66 provided in the corner of housing 12. Aperture 62 is aligned over a boss 68 formed in the interior of the housing adjacent the wall opposite boss 66. It will be understood that the unshown fasteners pass through the aperture 62,64 in the plate, and secure the plate to the bosses 66,68 by threaded of other type of frictional engagement with the bosses. Plate 60 has another aperture 70 formed therein which has received therethrough the upper end of spindle 26. Another aperture 72 is provided which has received therein the upper end of spindle 32; and, a third aperture 74 is provided which has received therein the upper end of spindle 38. It will be understood that the plate 60, when secured to the case bosses, thus supports the upper ends of the spindles to accurately locate the various drive gears in inter-engagement.

In the presently preferred practice, blind aperture 76 is provided on the undersurface of plate 60 for journalling and supporting the end of the motor shaft. Hub 58 of main driveshaft gear 56 is frictionally engaged by the inner surface of spring tabs 78 formed on a torque-limiting clutch member indicated generally at 80. Outwardly bent tabs 82 provided on each of the spring tabs 78 engage the inner surface of cylindrical wall 84 formed on the underside of a cam drum 86. Cam drum 86 has a hub 88, which has a bore formed axially therethrough, which bore has a flat surface 90 provided therein and which is received over shaft 50 and engages in driving engagement the flat surface 54 on shaft 50. Thus, torque imparted to gear 56 is transmitted by hub 58 through torque-limiting clutch 80 to the drum 86.

Figure 3:
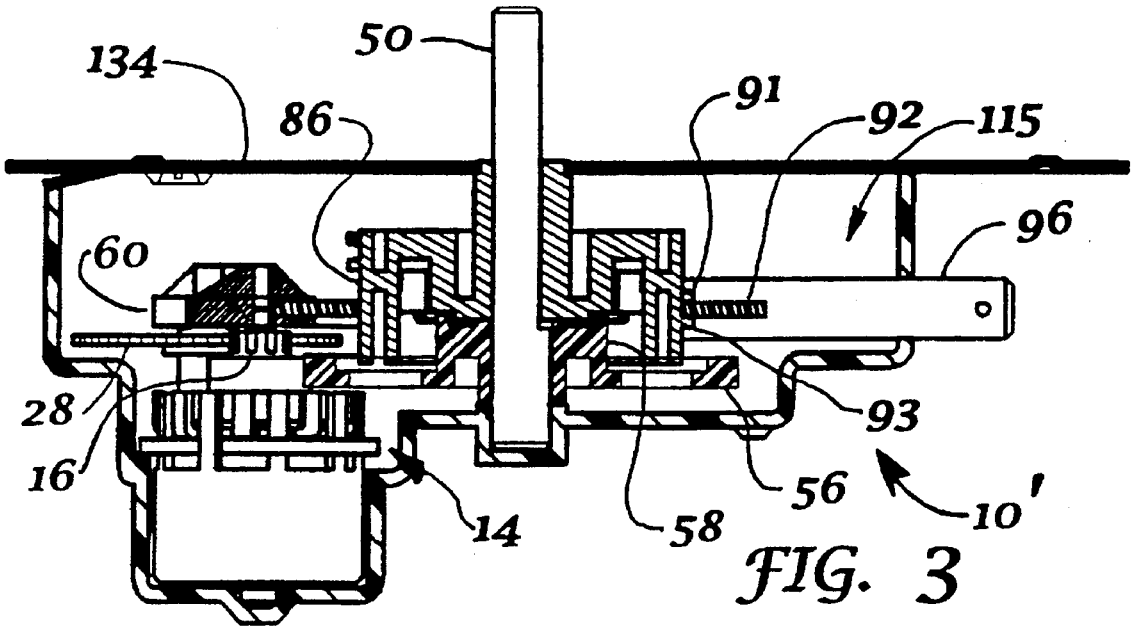
FIG. 3 is a section view of the invention in its basic form with a single cam drum and set of program switches.

Drum 86 has received over the outer periphery thereof in driving engagement as a pair of axially-spaced cam discs 92,94, which may be removably secured by any suitable expedient; as, for example, by snap-locking engagement, with the tabs 91,93 shown in FIG. 3.

The first cam follower blade 96 has one end thereof received in a slot 98 formed in the housing wall, and is operative at its other end to contact cam track 92 for effecting movement of a pair of switch contact blades 100, 102 disposed in spaced parallel arrangement therewith, each of which has one end thereof anchored in one of the slots 104, 106 provided in the wall of the housing adjacent slot 98. The blades 100, 102 form a switch indicated generally at 103.

A second cam follower blade 108 has one end thereof received in a slot 110 formed in the wall of housing 12; and, follower 108 is operative at its other end to contact cam track 94. Cam follower blade 108 is operative to effect electrical switching actuation between blades 112, 114 disposed one on either side thereof in spaced parallel arrangement. Blade 112 has one end thereof received in slot 118 formed in the wall of housing 12; and, blade 114 has one end thereof received in slot 116 formed in the wall of the housing adjacent slot 110. It will be understood that the switch blades 112, 114 form a switch 115 which may be connected by suitable electrical connections (not shown) for performing switching for various program control functions of an appliance sequentially in response To rotation of the cam tracks 92,94.

If desired, a sub-interval cam disc 120 may be provided, and is illustrated as received over and driven by the hub of pinion 42 on the third stage gear 40. The sub-interval cam 120 has a single cam surface 122 provided peripherally thereon which makes contact with a cam follower 124 pivoted about a hub 125 provided on the underside thereof, which is visible in FIG. 1 and is received in the aperture 74 provided in plate 60. The cam follower 124 has another lug or projection 126 formed thereon on the end remote from lug 125 which is operative to make contact with the switch blade 108 and effect sub-interval actuation thereof. In the present practice, cam track 94 acts as a masking cam to permit operation of the sub-interval cam member 126 only during a selected portion of the programs.

It will be understood that in the simplified embodiment of the invention shown in FIG. 1, the housing may be closed by a cover plate (not shown); and, the recess in the wall thereof for permitting installation of the switch blade members in the slots may be closed by a closure strip 128, making snap-locking engagement with the adjacent sidewalls 130, 132 of the housing.

Figure 4:
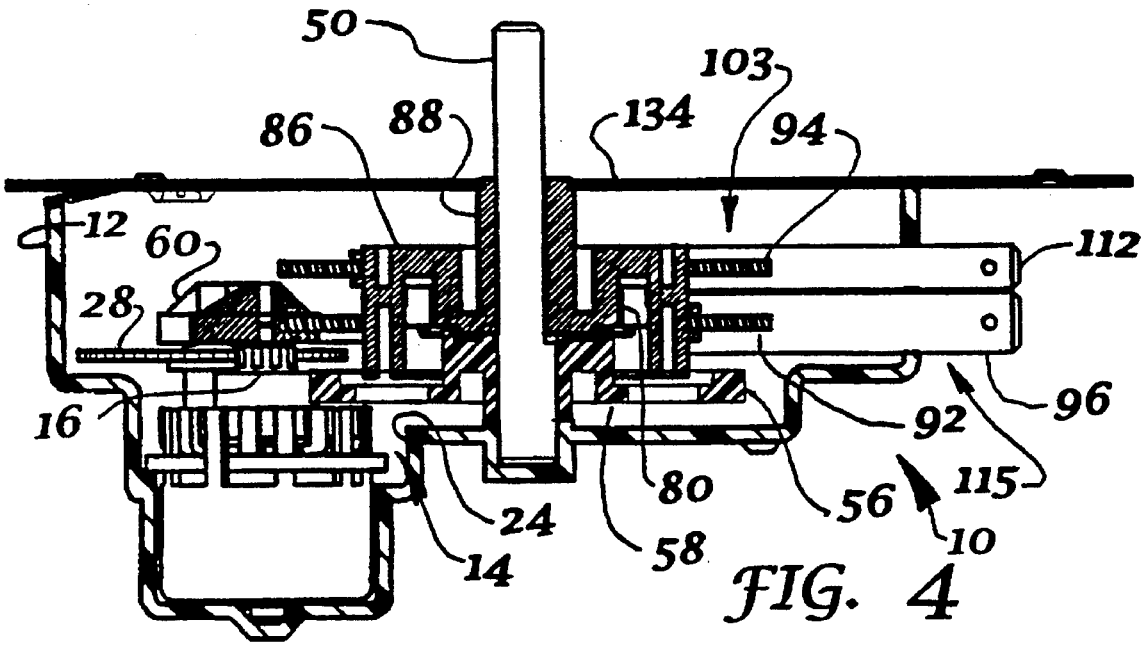
FIG. 4 is a view similar to FIG. 3, showing the embodiment of FIG. 3 with an additional cam track and set of program switches.

Referring to FIG. 4, the programmer/timer 10 is shown in cross-section in the assembled condition with the cover 134, omitted in FIG. 1, in place.

Referring to FIG. 3, a simplified form of the embodiment of FIGS. 1 and 4 is indicated generally at 10', wherein the upper cam disc 94 and switch 109 have been omitted, and only one cam track 92 is employed on the drum 85.

Figure 2:
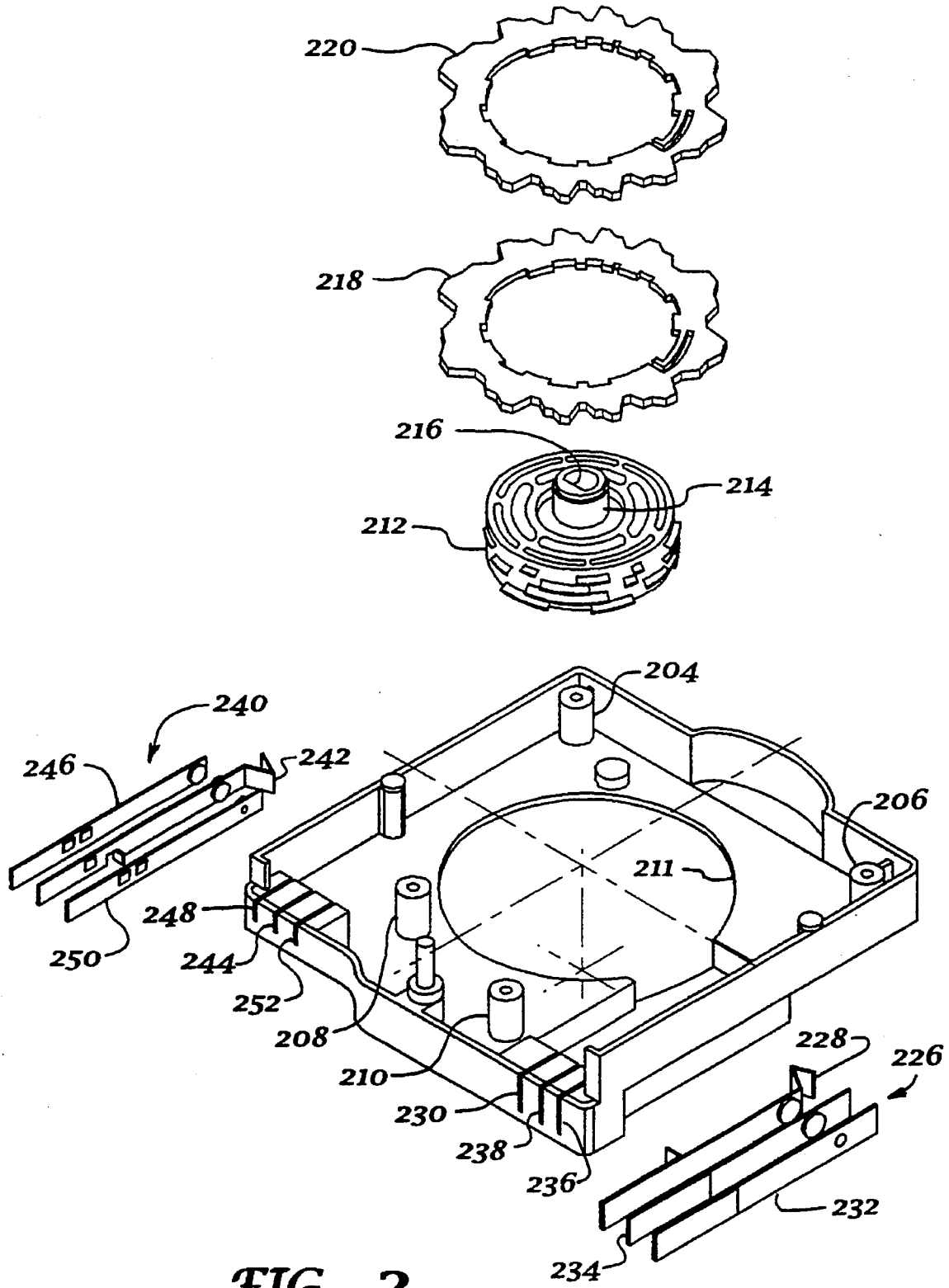
FIG. 2 is an exploded view of the auxiliary housing, cam, and program switches.
Figure 6:
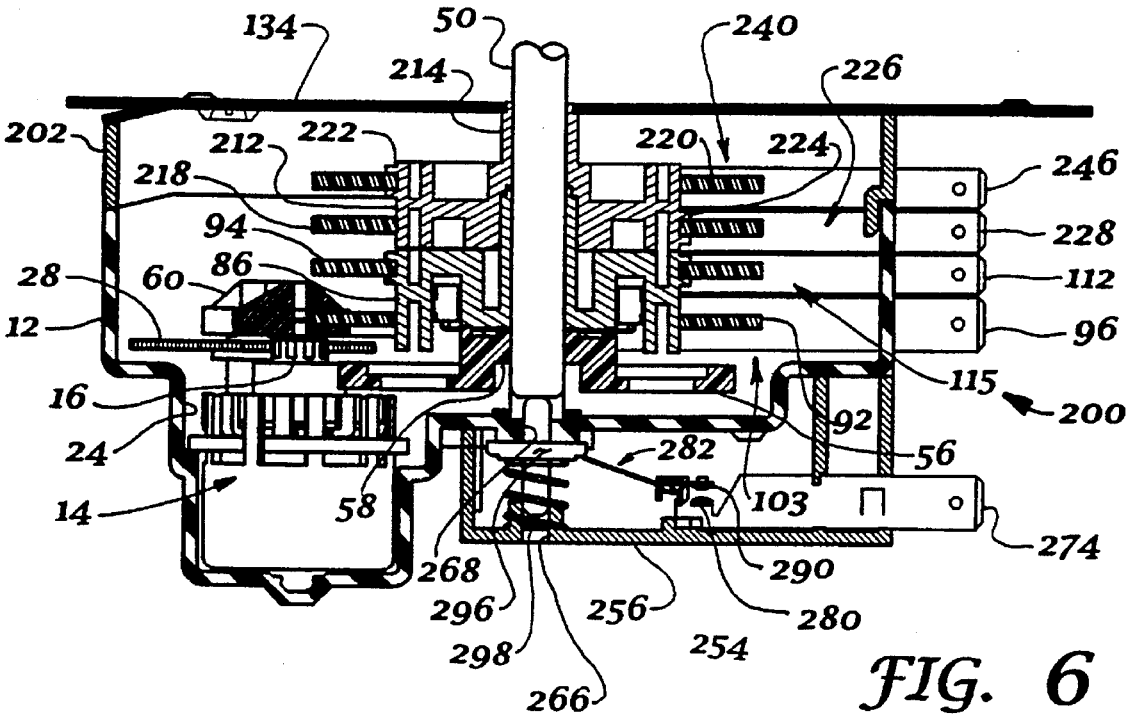
FIG. 6 is another embodiment, with the arrangement of FIG. 5 having an additional cam track on the auxiliary cam drum, and the push-to-start line switch.
Figure 7:
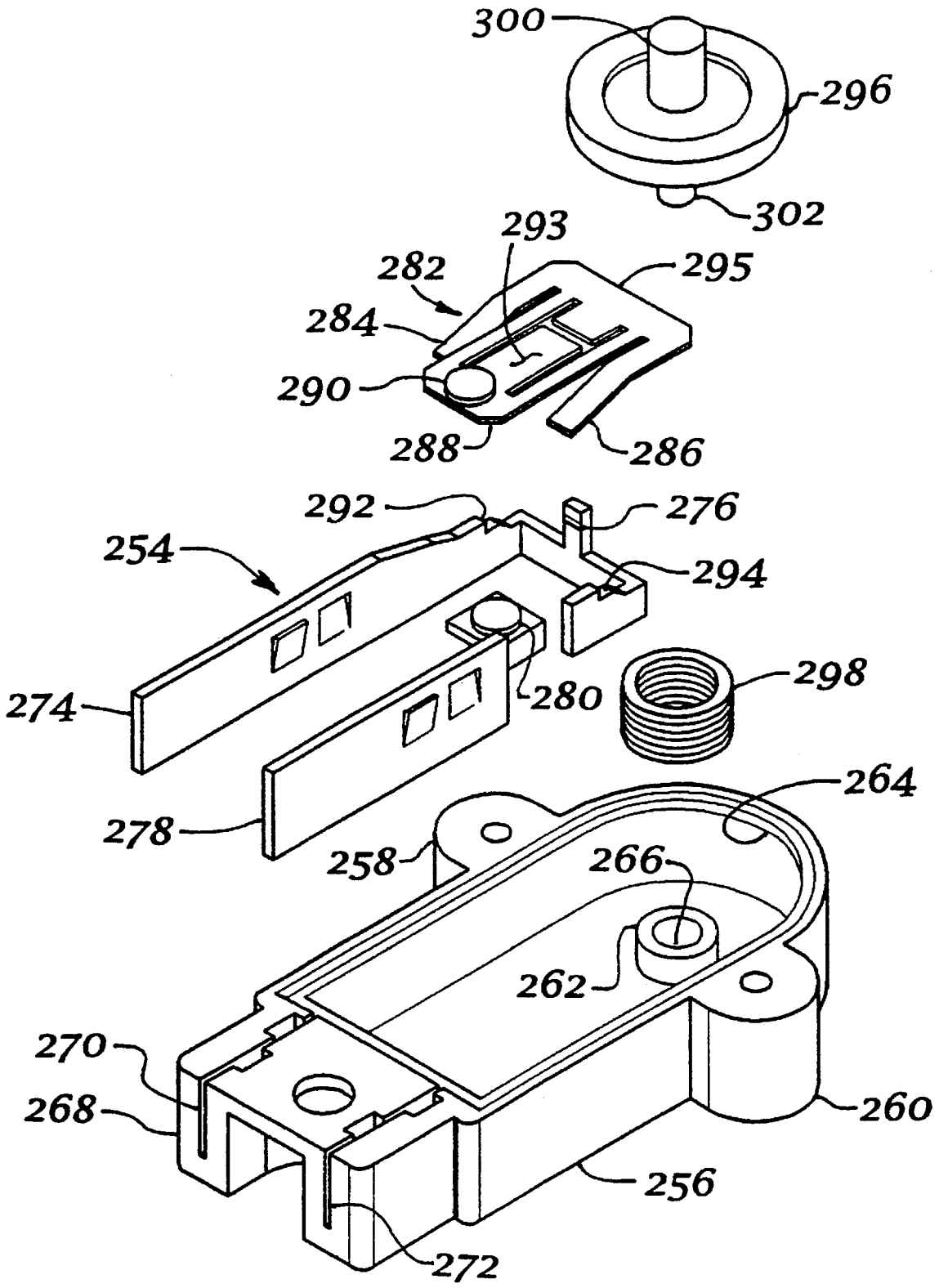
FIG. 7 is an axonometric exploded view of the push-to-start line switch of the embodiment of FIG. 6.

Referring to FIGS. 2, 6, and 7, another embodiment of the invention is illustrated generally at 200, wherein an auxiliary housing 202 is attached to the housing shell 12 by any suitable expedient as, for example, screws (not shown) through corner bosses 204,206, and side bosses 208,210, and threaded engagement into correspondingly disposed bosses 65,66, and 67,69 on the housing shell 12. The auxiliary case 202 has a relatively large central cut-out or aperture 211 which provides clearance for access to the cam drum 56 and shaft 50.

An auxiliary cam drum 212 is provided, and has a reduced diameter central hub 214 with an axial bore therethrough, which bore has a flat surface 216 provided therein; and, the hub is received over main shaft 50 and the surface 216 engages flat surface 54 (see FIG. 1) on shaft 50 such that rotation of shaft 50 causes rotation of drum 212. In the embodiment of FIG. 6, drum 212 has received thereover two additional cam discs 218,220, each of which has a peripheral cam track; and, the discs 218,220 are secured to drum 212 by suitable expedient as, for example, locking tabs 222,224, which are shown in FIG. 6.

With reference to FIGS. 2 and 6, an auxiliary switch assembly indicated generally at 226 includes a cam follower blade 228 having one end thereof received in slot 230 formed in auxiliary housing 202. Switch 226 has a pair of switch blades 232,234 having, respectively, one end thereof received in slots 236,238 formed in the housing 202 and are disposed in spaced-parallel arrangement with the follower blade 228. Cam follower blade 228 is operative to contact the peripheral cam track on cam disc 218 such that, upon rotation of the cam disc 218, sequential actuation and de-actuation of switch 226 is effected.

An additional auxiliary switch, indicated generally at 240, is provided and includes a cam follower blade 242 having one end thereof received in a slot 244 provided in the housing shell 202. The cam follower blade 242 is flanked on one side by electrical contact blade 246 disposed parallel to blade 242 and having one received in slot 248 and on the opposite side thereof, by blade 250 disposed parallel to blade 242 and having one end received in slot 252 provided in the housing shell 202. It will be understood that cam follower blade 242 contacts the peripheral cam track on cam disc 220 for, upon rotation thereof, effecting actuation and de-actuation of switch 240 in the desired sequence.

Referring to FIGS. 6 and 7, a push-to-actuate line power switch assembly indicated generally at 254 includes a switch housing 256 having a pair of bosses 258,260 provided on the opposite sides thereof, which bosses have apertures therein for receiving therethrough suitable fasteners (not shown) such as screws which engage threadedly holes provided in bosses 67,69 from the underside thereof in case 12.

An interior boss 262 formed in the cavity 264 of the housing 256 has an aperture or bore 266 therethrough which is aligned with an aperture 268 formed in the bottom of housing 12 coincident with the aperture 52 in the interior boss of housing 12. Housing 256 has a raised block portion 268 provided on the end opposite bosses 258,260; and, block portion 268 has a pair of spaced-parallel slots 270,272 provided therein. Slot 270 has received therein one end of a switch common blade member 274, which has a generally U-shaped portion on the opposite end thereof with a switch mounting stanchion or lug 276 extending upwardly therefrom. A second switch terminal member 278 has one end thereof received in slot 278 and the opposite end thereof provided with a stationary electrical contact 280 disposed centrally within the U-shaped portion of member 274.

A snap-acting switch blade assembly indicated generally at 282 has a pair of spaced-parallel spring arms 284,286 with a centrally disposed cantilever blade portion 288 having a movable contact 290 mounted thereon. The ends of spring arms 284,286 are each mounted in a notch denoted, respectively, 292,294 in the U-shaped end of blade member 274. An interior tab portion 293 of blade assembly 282 is anchored to the post 276 for securing the blade assembly to the members 274,278.

The end 295 of blade member 282 remote from the contact 290 is disposed directly under an actuator member 296 which contacts a recoil spring 298 disposed about boss 262 with the upper end thereof registered against the underside of actuator 296 for biasing it in an upward direction. Actuator 296 has a reduced diameter cylindrical portion 300 extending upwardly through aperture 268 formed in the bottom of case 12, and the end of portion 300 is contacted by the lower end of shaft 50. A reduced diameter pilot or guide portion 302 extends downwardly from the undersurface of actuator 296, and is slidably received in the bore 266 formed in boss 262 of the case 256 for guiding movement of the actuator 296. Upon user movement of shaft 50 axially in a downward direction, actuator 296 causes its guide portion 302 to press against the end 295 of switch 282 and effects closing of contact 290 against the stationary contact 280 for completing a circuit between members 274,278.

Figure 5:
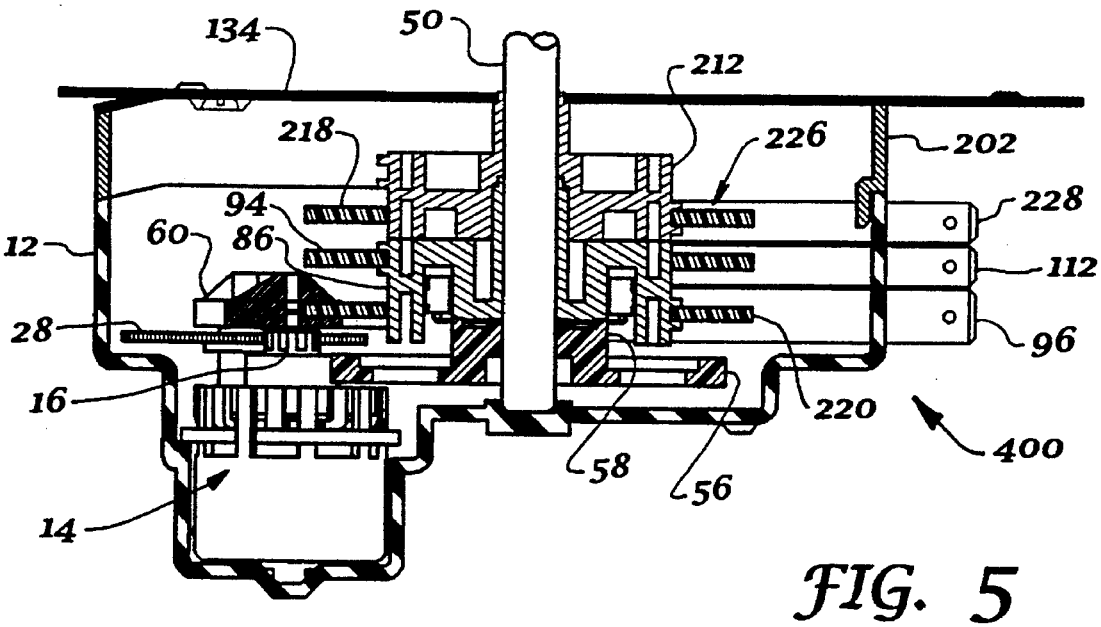
FIG. 5 is a section view of another embodiment having the auxiliary housing of FIG. 2 attached to the embodiment of FIG. 1, with an auxiliary cam drum and set of program switches.

Referring to FIG. 5, a simplified version of the embodiment 200 of FIG. 6 is indicated generally at 400, and differs from the embodiment of FIG. 6 only in the elimination of the auxiliary switch housing 254 and switch 282, and the elimination of the upper cam disc 220 and auxiliary switch 240, thereby providing an alternative version of the invention with the auxiliary section of the case added.

Figure 10:
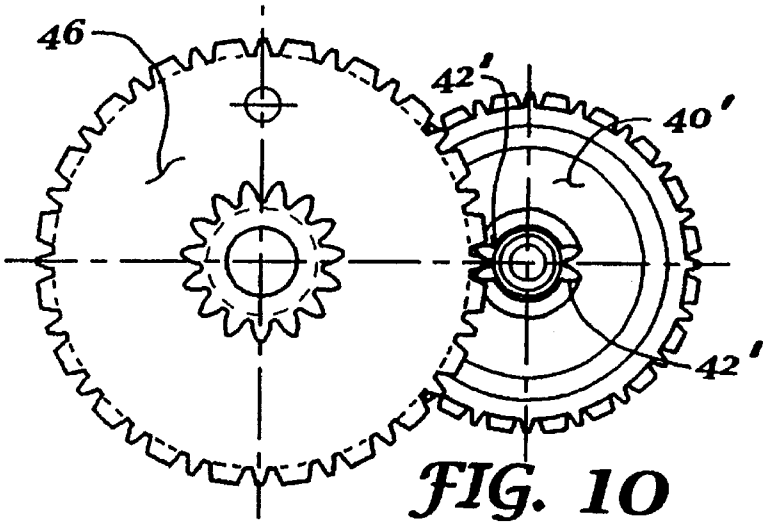
FIG. 10 is a view similar to FIG. 8, of another embodiment of the gear train; and, FIG. 11 is a view, similar to FIG. 8, of another embodiment of the gear train of FIG. 1.
Figure 11:
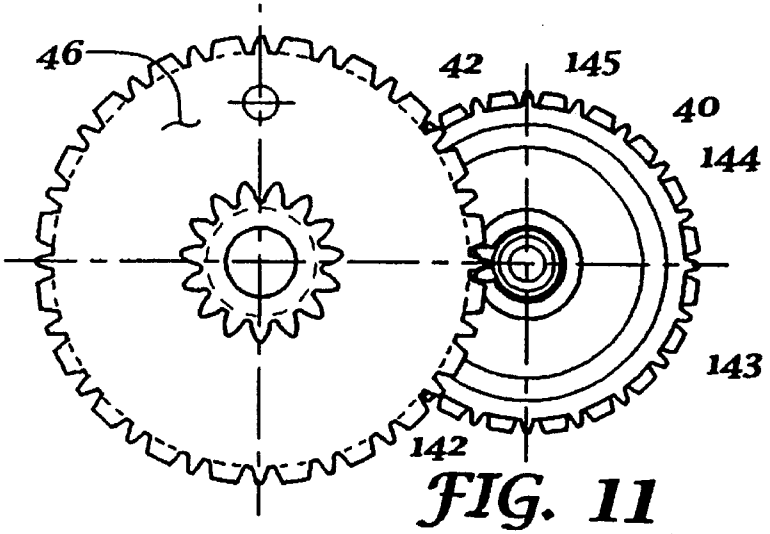

Referring to FIGS. 8 through 11, the third and fourth stage speed reducing gears of the advance mechanism are shown in detail wherein third stage gear 40 is shown in FIG. 11 as having the single pinion tooth 42 formed thereon and as having a notch formed therein, as denoted by reference numeral 142 in FIG. 11. The peripheral teeth 143 on gear 42 have a space 144 therebetween in which at least one tooth is missing. The teeth 143 are in one plane of the gear; whereas, a plurality of circumferentially spaced lugs 145 are circumferentially located between adjacent teeth 143, but in a plane of the gear displaced axially from teeth 143 or, in other words, at a different or staggered axial station. This permits a cylindrical portion provided on pinion 36 to engage the spaces between teeth 143 for half the width of the gear in order to prevent rotation thereof during periods of dwell in the intermittent drive. This technique for preventing rotation during blocking of the gear position is well known in the art of intermittent drive mechanisms. In the presently preferred practice of the invention, the single pinion 42 on gear 40 provides for a 300-minute interval or program of one complete rotation for the cam drum 86.

It will be understood that the same design is provided for the teeth of gear 46 as for the teeth of gear 40.

Referring to FIG. 10, an alternative embodiment of the third stage gear 40' is indicated as having two pinion teeth 42' for increasing the rate of advance of fourth stage gear 46.

Figure 9:
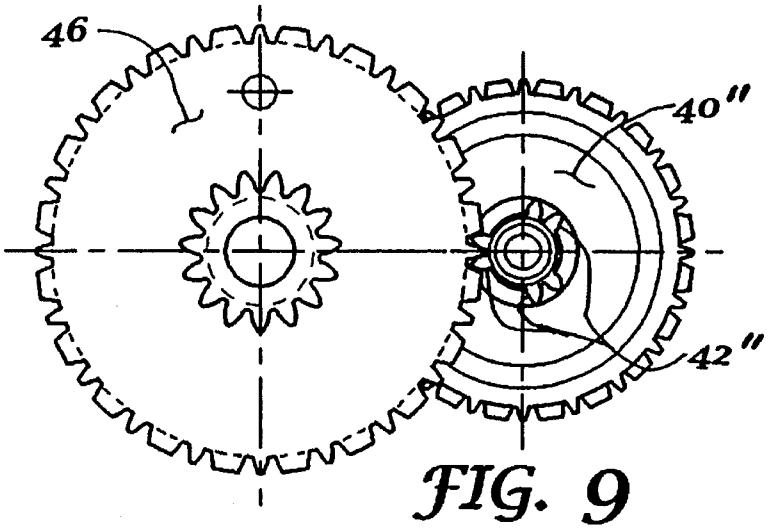
FIG. 9 is a view similar to FIG. 8, of another embodiment of the gear train.

Referring to FIG. 9, another embodiment of the third stage gear 40" is shown, wherein the pinion employs a set of three pinion teeth 42" to further increase the rate of advance of fourth stage gear 46.

Figure 8:
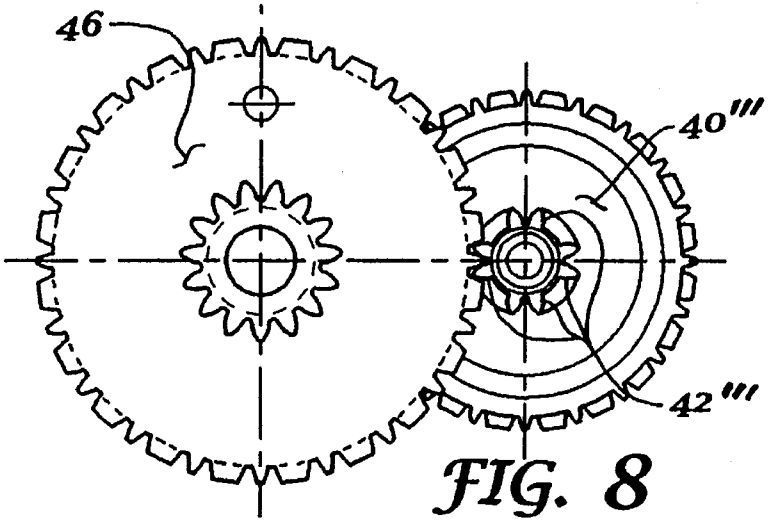
FIG. 8 is a detail view of a portion of the gear drive of FIG. 1, showing the third and fourth stage gears.

Referring to FIG. 8, another embodiment of the drive train is shown, wherein the third stage gear 40''' employs a pinion having pinion teeth 42''' for further increasing the rate of advance of fourth stage gear 46. It will be apparent that the only difference in the embodiments of FIGS. 8 through 11 is the number of pinion teeth on the output pinion on the third stage gear 40; and, the gears 40, 40', 40", and 40''' are interchangeable insofar as meshing with adjacent gears and the center-to-center distance required for proper driving engagement thereof. In order to change the rate of advance of the programmer/timer of the present invention, it is thus merely required to remove the gear plate 60 and mainshaft, and fourth stage gear 46 to remove the third stage gear 40, and replace gear 40 with one of the other varieties thereof.

The present invention thus provides for adding additional switches and program cams by adding the auxiliary housing 202 and auxiliary cam drum 212 as additions to the basic timer employing only a single cam drum. Furthermore, either the basic timer or the timer with the auxiliary section added is capable of being fabricated with any one of several different advance rates for changing the length of the appliance program by merely interchanging the third stage gear in the speed reducer section.

Although the invention has hereinabove been described with respect to the illustrated embodiments, it will be understood that the invention is capable of modification and variation, and is limited only by the following claims.

We claim:

1. A modular programmer/timer comprising:

(a) housing means including a first housing shell and a second housing shell releasably attached thereto forming a first and second compartment;

(b) user-rotatable shaft means mounted on said housing means through said first and second compartments and having portions thereof extending externally of said housing means and having torque-transmitting surfaces thereon;

(c) a first program cam means including hub means axially slidably received on said shaft means and operatively engaging said torque-transmitting surfaces, said cam means having at least one program cam track thereon disposed in said first compartment;

(d) a first program switch means disposed in said first compartment and including follower means operable to follow said at least one cam track;

(e) motorized advance means operable to advance said cam means upon energization;

(f) torque limiting means interposed between said advance means and said cam means for permitting manual torque override and user setting of said cam means;

(g) a second program cam means including hub means axially slidably received on said shaft means and operatively engaging said torque-transmitting surfaces, said second program cam means having at least one program cam track thereon disposed in said second compartment; and, (h) a second program switch means disposed in said second compartment and including follower means operable to follow said second cam means at least one cam track.

2. The programmer/timer defined in claim 1, wherein said shaft means is user movable axially; and, further comprising line switch means series connected with said motorized advance means and including an actuator member operable to be actuated and deactuated by said axial movement of said shaft means.

3. The programmer/timer defined in claim 1, wherein said advance means includes a gear train with intermittent drive means.

4. The programmer/timer defined in claim 1, wherein said advance means includes a gear train with a sub-interval cam driven by one of the gears in said train; and sub-interval switch means including follower means following said sub-interval cam means.

5. The programmer/timer defined in claim 1, wherein said second cam means is axially nested against said first cam means.

6. The programmer/timer defined in claim 1, wherein at least one of said first and second program cam means cam track is releasably attached to a hub means.

7. The programmer/timer defined in claim 1, wherein said housing means includes a third housing shell releasably attached to said first housing shell and including line switch means operatively responsive to user axial movement of said shaft means for actuation and deactuation.

8. The programmer/timer define in claim 7, wherein said line switch means has a snap-action.

9. The programmer/timer defined in claim 1 wherein at least one of said first and second program cam means has a plurality of cam tracks, each releasably attached to a hub means.

10. The programmer/timer defined in claim 1, wherein said advance means includes a gear train with one gear having missing teeth for providing an intermittent drive.

11. The programmer/timer defined in claim 1, wherein one of said first and second program cam means comprises an annular cam ring releasably attached to said hub means.

12. A programmer/timer for electrically operated appliances comprising:

(a) housing means having a motorized drive means associated therewith, said motorized drive means including:

(i) a motor having a motor pinion on the motor shaft;

(ii) a first stage gear wheel having continuous peripheral teeth engaging said motor pinion and a first stage pinion having missing teeth thereon;

(iii) a second stage gear wheel peripherally engaging said first stage pinion for intermittent drive, said second stage wheel having a second stage pinion thereon with missing teeth;

(iv) a third stage gear wheel having the periphery thereof with missing teeth engaging said second stage pinions, for intermittent drive therebetween, said third stage wheel locked against rotation by the space between teeth engaging separate surfaces on said second stage pinion during the dwell periods of said intermittent drive, said third gear wheel having an output pinion with missing teeth;

(v) a fourth stage gear wheel having the periphery thereof engaging said third stage gear wheel pinion for intermittent drive therebetween, said fourth stage gear wheel locked against rotation by said space between teeth engaging separate surfaces on said third stage pinion during the dwell period of said intermittent drive, wherein said third stage gear wheel may be removed and replaced with the number of pinion teeth changed without requiring changing either of said second and fourth stage gear wheel; and, (b) cam means engaging and rotated by said fourth stage gear wheel; and, (c) at least one appliance program switch including cam follower means, operative to be actuated and deactuated by advancement of said cam means.

* * * * *